US012723822B2

(12) United States Patent
Thayer et al.

(10) Patent No.: US 12,723,822 B2
(45) Date of Patent: Sep. 1, 2026

(54) HEAT PIPE WITH BRAZED SEAM

(71) Applicant: Thermal Corp., Wilmington, DE (US)

(72) Inventors: John Thayer, Lancaster, PA (US); Sergey Semenov, Lancaster, PA (US); Nelson J. Gernert, Elizabethtown, PA (US)

(73) Assignee: Aavid Thermal Corp., Wilmington, DE (US)

( * ) Notice: Subject to any disclaimer, the term of this patent is extended or adjusted under 35 U.S.C. 154(b) by 314 days.

(21) Appl. No.: 16/732,629

(22) Filed: Jan. 2, 2020

(65) Prior Publication Data

US 2020/0208920 A1 Jul. 2, 2020

Related U.S. Application Data

(60) Provisional application No. 62/787,524, filed on Jan. 2, 2019.

(51) Int. Cl.
*F28D 15/02* (2006.01)
*F28D 15/04* (2006.01)

(52) U.S. Cl.
CPC ..... *F28D 15/0283* (2013.01); *F28D 15/0266* (2013.01); *F28D 15/04* (2013.01)

(58) Field of Classification Search
CPC .. F28D 15/04; F28D 15/0283; F28D 15/0266; F28D 15/046; B23P 2700/09; H05K 7/20336; F28F 2245/00; F28F 2275/04; F28F 2275/045; F28F 13/18; F28F 21/085
USPC ..... 29/890.032
See application file for complete search history.

(56) References Cited

U.S. PATENT DOCUMENTS 2,874,941 A * 2/1959 Woofard ..... F28D 9/0062 165/170
3,154,139 A * 10/1964 Hager, Jr. ..... F28D 15/0233 62/383
3,587,725 A * 6/1971 Basiutis ..... F28D 15/046 165/104.26
3,769,674 A * 11/1973 Droughton ..... F28D 15/04 29/890.032

(Continued)

FOREIGN PATENT DOCUMENTS

JP 2011238756 A * 11/2011 ..... G06F 1/20

*Primary Examiner* — Travis Ruby
(74) *Attorney, Agent, or Firm* — Micheal Best & Friedrich LLP

(57) ABSTRACT

A heat transfer device includes a hollow metal body. The hollow body defines a wall having a thickness, an internal chamber defined at least in part by the wall, a vacuum defined in the internal chamber, a seam defined between two different portions of the wall and extending through the thickness of the wall, a brazing material applied to the seam to hermetically seal the internal chamber and maintain the vacuum in the internal chamber, an evaporation region in which heat is received in the hollow metal body, and a condenser region from which heat is discharged from the hollow metal body. The heat transfer device further includes a charge of ice within the internal chamber, the charge of ice sufficiently large to define, when in a thawed state, a working fluid drawing heat from the evaporator region and discharging heat from the condenser region in a working cycle of the heat transfer device.

12 Claims, 7 Drawing Sheets

(56) References Cited

U.S. PATENT DOCUMENTS 3,982,680 A * 9/1976 Ishikawa ..... F28D 1/0478 228/174
4,408,655 A * 10/1983 Hashimoto ..... C09K 5/04 252/68
5,381,859 A * 1/1995 Minakami ..... F28D 15/0275 174/16.3
5,692,300 A * 12/1997 Conn ..... B23K 1/0012 29/890.053
6,269,866 B1 * 8/2001 Yamamoto ..... F28D 15/0233 174/15.2
6,298,910 B1 * 10/2001 Komoda ..... F16N 39/02 165/167
6,412,174 B1 * 7/2002 Kawano ..... F28D 1/035 228/183
6,799,630 B1 * 10/2004 Kato ..... B23K 1/0012 165/170
7,143,511 B2 * 12/2006 Connors ..... F28D 15/04 29/890.032
7,661,464 B2 * 2/2010 Khrustalev ..... F28D 15/0266 165/104.21
2002/0056542 A1 * 5/2002 Yamamoto ..... F28D 15/0233 257/E23.098
2002/0135979 A1 * 9/2002 Estes ..... H05K 7/20309 361/688
2005/0034848 A1 * 2/2005 Ueda ..... F28D 1/0535 165/177
2006/0096739 A1 * 5/2006 Lee ..... F28D 15/0283 165/104.21
2006/0150669 A1 * 7/2006 Kitamura ..... F16L 13/08 29/890.038
2006/0180299 A1 * 8/2006 Igami ..... F28D 1/0391 165/177
2006/0202474 A1 * 9/2006 Hsu ..... F28D 15/0283 285/286.2
2007/0062036 A1 * 3/2007 Tung ..... H01L 21/4882 29/890.032
2007/0074395 A1 * 4/2007 Hou ..... H01L 21/4882 29/890.032
2007/0131388 A1 * 6/2007 Khrustalev ..... F28D 15/0266 165/104.28
2007/0289134 A1 * 12/2007 Lee ..... B23P 15/26 29/890.032
2009/0072534 A1 * 3/2009 Hsu ..... F28D 15/0283 285/286.2
2009/0308576 A1 * 12/2009 Wang ..... B23P 15/26 29/890.032
2009/0314478 A1 * 12/2009 Yamada ..... F28D 15/0283 165/133
2013/0168057 A1 * 7/2013 Semenic ..... B64G 1/50 165/104.21
2014/0329109 A1 * 11/2014 Takewaka ..... C22C 21/02 428/654
2015/0027668 A1 * 1/2015 Yang ..... H05K 7/20336 165/104.21
2015/0027679 A1 * 1/2015 Singh ..... B23K 1/206 165/182
2015/0060021 A1 * 3/2015 Chauhan ..... F28D 15/046 29/890.032
2016/0252308 A1 * 9/2016 Strehlow ..... F28D 15/046 165/104.26
2017/0205160 A1 * 7/2017 Yanagawa ..... B32B 15/016
2018/0066899 A1 * 3/2018 Hsieh ..... B23K 15/008
2018/0106564 A1 * 4/2018 Isaacs ..... B22F 10/28
2018/0231334 A1 * 8/2018 Gandrothula ..... B23K 1/008
2018/0259267 A1 * 9/2018 Tsai ..... H05K 7/20263
2018/0297138 A1 * 10/2018 Yamayoshi ..... B23K 1/008

* cited by examiner

HEAT PIPE WITH BRAZED SEAM

CROSS-REFERENCE TO RELATED APPLICATIONS

Priority is hereby claimed to U.S. provisional patent application No. 62/787,524 filed on Jan. 2, 2019, the entire contents of which are incorporated herein by reference.

BACKGROUND

Heat pipes are commonly used to remove heat from a heat source, such as an electronic component. Heat pipes may be made, for example, of a conductive material such as copper, and contain a phase-change working fluid, such as water. The phase changes of the working fluid are used to dissipate heat from the heat source. Heat pipes commonly include an evaporator region that is in thermal communication with the heat source to receive heat from the heat source, and a condenser region in thermal communication with the evaporator region, where the heat is discharged to another element or device, or is otherwise dissipated to the external environment. Many heat pipes are hollow, and may include a wick structure disposed along an internal wall of the heat pipe to generate a capillary action to facilitate return of working fluid from the condenser region to the evaporator region.

In brief, the working fluid in the evaporator region of the heat pipe absorbs heat generated by and received from the heat source. The heat received from the heat source is absorbed by and vaporizes the working fluid (i.e., changes the phase of the working fluid), thereby transporting the heat away from the heat source. The heated vapor then flows to the cooler condenser region of the heat pipe, where the vaporized working fluid condenses and changes phase back to its liquid state. Condensation of the vaporized working fluid dissipates the absorbed heat from the working fluid for removal from the condenser region of the heat pipe to another device or element, or to the external environment. The cooled working fluid then returns in a liquid state to the evaporator region, often facilitated by capillary action provided by a wick structure. Once returned to the evaporator region of the heat pipe, the working fluid again absorbs heat generated by the heat source. This heat transfer cycle is continuously repeated as long as the heat source generates heat.

Heat pipes, including cylindrical heat pipes (e.g., cylindrical copper/water heat pipes) are commonly formed and closed off at one or both ends by mechanically closing the end or ends of the heat pipe, such as by spinning the end or ends of the heat pipe to form a closed taper at the end or ends, pinching the end or ends of the heat pipe, or otherwise deforming the end or ends of the heat pipe in other ways to close the open ends thereof. Some heat pipes are closed off by one process (e.g., welding) at one end and are closed off via another process (e.g., pinching) at the opposite end. This formation process results in a seam or seams at the end or ends of the heat pipe. The seam or seams are then commonly welded shut, isolating an internal vacuum chamber/vapor chamber within the heat pipe, within which working fluid flows between the evaporator and condenser regions of the heat pipe in use. Welding has commonly been used as a preferred means for sealing these seams due to its low cost and ease of application.

Welded copper/water heat pipes have become commonplace, and are used in a variety of settings and industries. In low temperature environments, however, where water may freeze, some welded copper/water heat pipes may have a limited lifespan. When there is excess fluid in the heat pipe, the failure of the heat pipe is known. However, when all precautions to eliminate the failure are implemented, unknown failures can still occur. Thus, the inventors understand that the conventional wisdom has been to either repeatedly replace copper/water heat pipes used in low-temperature environments where freeze/thaw cycles are repeatedly encountered before the heat pipes fail, or to use different working fluids than water that will not freeze in the low-temperature environments.

SUMMARY

The inventors have discovered that despite the belief held by some in the industry that heat pipes which use water as the working fluid (e.g., copper/water heat pipes) are unacceptable for use in environments in which the heat pipe experiences freeze-thaw cycles, such heat pipes can in fact function properly, given certain new design parameters discovered by the inventors. In this regard, the inventors have discovered that the initial heat pipe production process (described above) often causes rough, uneven, undulating surfaces, jagged ridges, fissures, cracks, crevasses, voids, pores, and/or other imperfections (collectively "imperfections") at the end of the heat pipe and/or along the internal surfaces of the heat pipe. Owing to the facts that these often microscopic (or even smaller) imperfections are typically imperceptible to the human eye and are located on internal surfaces of the heat pipe that are otherwise hidden from view, the root cause of water-based heat pipe failure has not been completely recognized. When water is used as a working fluid, the water finds its way into these imperfections (e.g., pools, or otherwise accumulates at or within the imperfections). If the heat pipe is used in a low temperature environment in which the water freezes within or accumulates at the imperfections, the freezing water may cause cracks, fissures, deterioration, and/or other damage to the heat pipe, such as eventually propagating a hole or crack that extends through the heat pipe, allowing air to leak in or fluid to leak out and thereby causing failure of the heat pipe. Additionally, the inventors have discovered that conventional heat pipe welding processes may also introduce imperfections (e.g., pores) within the welded material or weld area that may also serve as imperfections within which water accumulates and freezes, again causing damage to the heat pipe when the heat pipe is subjected to freezing conditions.

The inventors have discovered a number of advancements that serve to reduce or eliminate heat pipe failure or damage that may otherwise occur due to repeated freeze/thaw cycles in low temperature environments, including when water is used as the working fluid. As described and illustrated in greater detail herein, these advancements include processing of welded heat pipe locations (e.g., ends), brazing heat pipe seams and other heat pipe locations (e.g., instead of welding), and utilization of heat pipe end caps and/or heat pipe wicks adapted for freeze/thaw applications. In this regard, the inventors have discovered that welded heat pipes may in fact be used in low temperature environments, for example where certain other features (e.g., polishing and other surface processing, end caps, and/or wicks) are also employed to help reduce or eliminate heat pipe failure or damage. Thus, despite conventional wisdom that many heat pipes (e.g., those using water as a working fluid) may not be suitable for low temperature applications, such as in cases of repeated freeze/thaw cycles, the inventors have discovered that both welded and brazed heat pipes may in fact be used and functional well in such applications, proper preparation and features.

In accordance with some embodiments, a heat transfer device includes a hollow body comprised of metal. The hollow body defines a wall having a thickness, an internal chamber defined at least in part by the wall, a vacuum defined in the internal chamber, a seam defined through the thickness of the wall, a brazing material at least partially filling the seam to hermetically seal the internal chamber and to maintain the vacuum in the internal chamber, an evaporation region in which heat is received into the hollow body, and a condenser region from which heat is discharged from the hollow body. The heat transfer device further includes a charge of ice within the internal chamber, the charge of ice sufficiently large to define, when in a thawed state, a working fluid drawing heat from the evaporator region and discharging heat from the condenser region in a working cycle of the heat transfer device.

In accordance with some embodiments, a method of using a heat pipe includes containing a working fluid under vacuum within an internal chamber of the heat pipe, and wetting an internal surface of a brazing material of the heat pipe with the working fluid within the heat pipe, the brazing material at least partially filling a seam of the heat pipe. The method further includes freezing the working fluid on the internal surface of the brazing material, thawing the working fluid on the internal surface of the brazing material, heating an evaporator region of the heat pipe, evaporating working fluid within the heat pipe proximate the evaporator region after thawing the working fluid, cooling a condenser region of the heat pipe, condensing working fluid within the heat pipe proximate the condenser region of the heat pipe after evaporating the working fluid, maintaining a hermetic seal at the seam after evaporating and condensing the working fluid, and repeating the containing, wetting, freezing, thawing, heating, evaporating, cooling, condensing, and maintaining steps for a plurality of cycles of the heat pipe.

In accordance with some embodiments, a method of forming a heat pipe includes mechanically closing off an end of a heat pipe to form a seam at the end of the heat pipe, applying an internal layer of brazing material to an internal surface of the heat pipe at the seam, and smoothing an internal surface of the internal layer of brazing material with a tool In accordance with some embodiments, a method of forming a heat pipe includes mechanically closing off an end of a heat pipe to form a seam at the end of the heat pipe, smoothing an internal surface of the heat pipe at the seam with a tool, and applying an internal layer of brazing material to the smoothed internal surface of the heat pipe at the seam In accordance with some embodiments, a method of forming a heat pipe includes mechanically closing off an end of a heat pipe to form a seam at the end of the heat pipe, applying an internal layer of brazing material to an internal surface of the heat pipe at the seam, and forming a wick structure within an internal of the heat pipe. The wick structure extends entirely around an inside of the end of the heat pipe and over the internal layer of brazing material.

In accordance with some embodiments, a method of forming a heat pipe includes closing off an end of a heat pipe, and smoothing an internal surface of the heat pipe at the end of the heat pipe with a tool.

In accordance with some embodiments, a method of forming a heat pipe includes closing off an end of a heat pipe, forming a wick structure within an interior of a heat pipe, and smoothing an internal surface of the wick structure with a tool In accordance with some embodiments, a method of forming a heat pipe includes spinning an end of a heat pipe to close off the end of the heat pipe and form a seam at the end of the heat pipe, smoothing an internal surface of the heat pipe at the seam with a tool, applying an internal layer of brazing material to the smoothed internal surface of the heat pipe at the seam, smoothing an internal surface of the internal layer of brazing material, forming a wick structure within the heat pipe, and applying an external layer of brazing material to an external surface of the heat pipe at the seam.

Other aspects of the invention will become apparent by consideration of the detailed description and accompanying drawings.

DETAILED DESCRIPTION

Before embodiments of the invention are explained in detail, it is to be understood that the invention is not limited in its application to the details of construction and the arrangement of components set forth in the following description or illustrated in the accompanying drawings. The invention is capable of other embodiments and of being practiced or of being carried out in various ways. Also, it is to be understood that the phraseology and terminology used herein is for the purpose of description and should not be regarded as limited.

Figure 1:
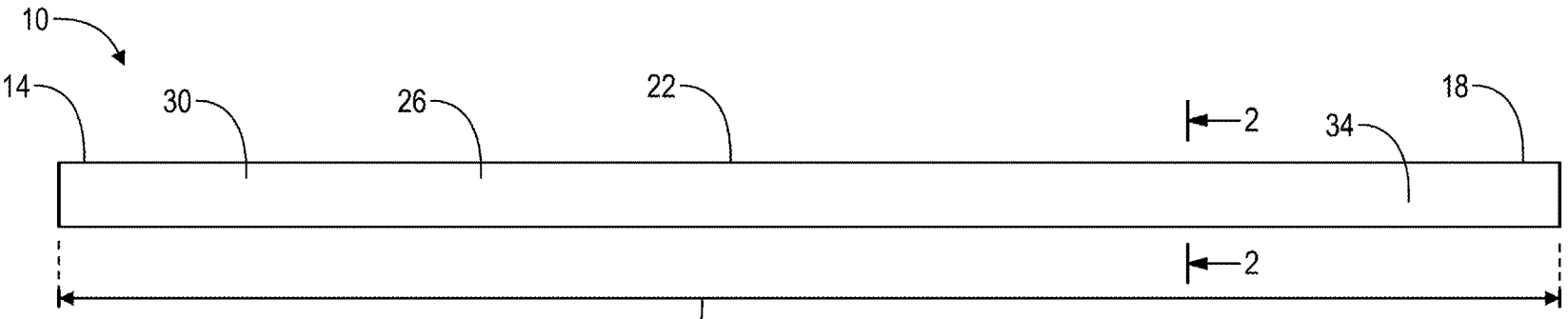
FIG. 1 is a perspective view of a heat pipe according to one embodiment.
Figure 2:
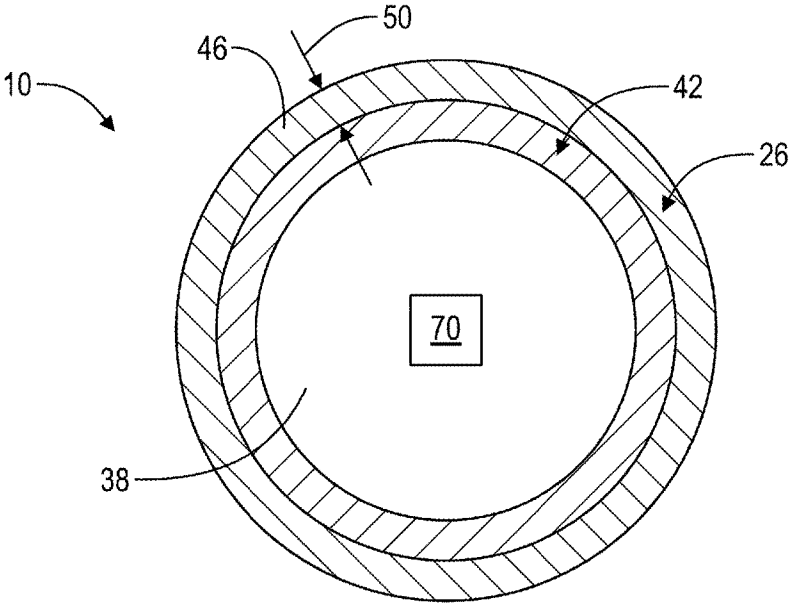
FIG. 2 is a cross-sectional view of the heat pipe of FIG. 1, taken along lines 2-2 in FIG. 1.

FIGS. 1 and 2 illustrate an exemplary embodiment of a heat pipe 10 having a first end 14, a second end 18, and an intermediate region 22 disposed between the first and second ends 14, 18 along a length 24 of the heat pipe 10. The first and second ends 14, 18 may be terminal ends. In the illustrated embodiment, the heat pipe 10 has a generally straight, or linear profile that extends from the first end 14 to the second end 18. The heat pipe 10 is generally tubular, and has an elongated hollow body 26 (e.g., heat pipe casing) formed for example from copper, a copper alloy, aluminum, titanium, stainless steel, or other suitable metals or non-metals (e.g., polymers).

In the illustrated embodiment of FIGS. 1 and 2, the hollow body 26 is cylindrical, and has a constant diameter along the length of the heat pipe 10. In other embodiments, the hollow body 26 has a diameter that varies along the length of the heat pipe 10 (e.g., is larger in the intermediate region 22 than at the first and second ends 14, 18). In yet other embodiments, the hollow body 26 is oval in cross-section, as opposed to circular, or has other cross-sectional shapes (e.g., square, rectangular, irregular, etc.).

In some embodiments, one portion of the heat pipe 10 may have a first cross-sectional shape with another portion at a different location along the length of the heat pipe 10 having a different cross-sectional shape. For example, the first end 14 and/or the second end 18 may each have a generally flattened, oval-shaped, or rectangular cross-section, whereas the intermediate region 22 may have a circular-shaped or rounded cross-section. The heat pipe 10 may also have one or more flat regions, such as where the heat pipe 10 is to be joined to a device to be cooled or to a heat sink to shed the heat.

With continued reference to FIGS. 1 and 2, the heat pipe 10 includes an evaporator region 30 and a condenser region 34. The evaporator region 30 is located at the first end 14 and the condenser region 34 is located at the second end 18, although in other embodiments the evaporator region 30 and/or the condenser region 34 may be located at other areas of the heat pipe 10. For example, the evaporator region 30 and/or the condenser region 34 may overlap with or be located entirely within the intermediate region 22. Alternatively, the evaporator region 30 may be located at the second end 18, and the condenser region 34 may be located at the first end 14.

As illustrated in FIG. 2, the heat pipe 10 includes a hollow, internal vapor chamber 38 sized to contain a working fluid. As illustrated in FIG. 2, the heat pipe 10 can also include a capillary wick structure 42 for moving the working fluid within the heat pipe 10. The capillary wick structure 42 may extend at least partially within the heat pipe 10 from the condenser region 34 to the evaporator region 30, lining an internal surface of the vapor chamber 38. In some embodiments, the wick structure 42 is located at either or both of the evaporator and condenser regions 30, 34, whereas in other embodiments either or both of evaporator and condenser regions 30, 34 do not include a wick structure 42. Also, in some embodiments the wick structure 42 extends without interruption along any part or all of the distance between the evaporator and condenser regions 30, 34. The wick structure 42 may be made, for example, from sintered or brazed copper powder or other suitable materials, and/or may include or be defined by axial grooves, webs, one or more mesh objects, or other capillary structures along the interior of the heat pipe 10 (either attached to or unattached from with the hollow body 26) that facilitate a wicking capillary action in one or more areas of the heat pipe 10. In some embodiments, the heat pipe 10 may include one or more bare areas (e.g., defining the evaporator and/or condenser regions 30, 34, or any portion thereof) that do not include a wick structure 42. The wick structure 42 may permit the heat pipe 10 to be used in low-gravity environments, and in other applications in which force is needed to move the working fluid in a desired direction (e.g., from the condenser region 34 toward the evaporator region 30), such as capillary force. The wick structure 42 may have a constant thickness, or have a varying thickness (e.g., a constant varying thickness, or a stepped thickness) along any part of the length of the heat pipe 10 between the evaporator and condenser regions 30, 34.

Figure 3:
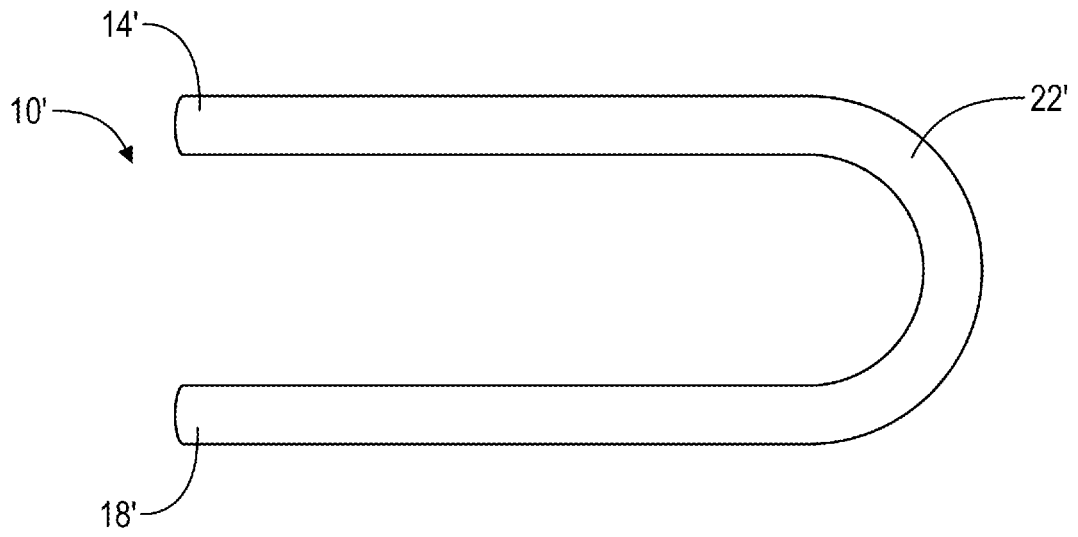
FIGS. 3 and 4 are perspective views of heat pipes according to other embodiments having shapes different than that of FIG. 1.

When heat is applied to the working fluid at the evaporator region 30, the working fluid evaporates, changing phase into a vapor state. The working fluid flows through the internal vapor chamber 38 in the vapor state from the evaporator region 30 to the condenser region 34 (e.g., through a bend 22' in the heat pipe 10 as shown in FIG. 3). The working fluid then changes phase again back to a liquid state at the condenser region 34 as the working fluid discharges its heat to an object in thermal communication with the condenser region 34 of the heat pipe 10 or to the environment around the condenser region 34 of the heat pipe 10, and returns in the liquid state (e.g., is guided) from the condenser region 34 to the evaporator region 30 through the wick structure 42 (when provided).

Figure 4:
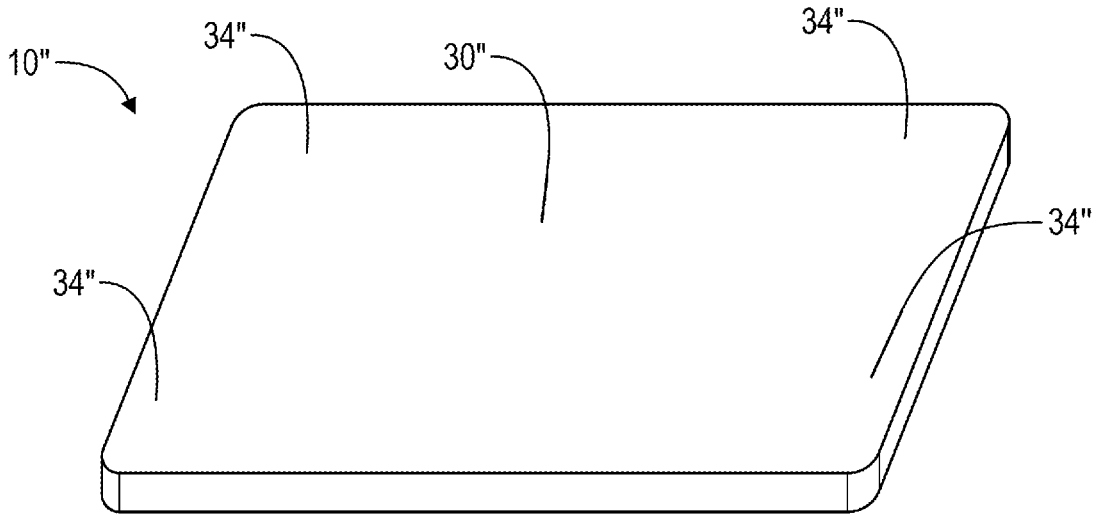

While the heat pipe 10 of FIGS. 1 and 2 is generally linear in overall shape, the heat pipe 10 may also have other shapes. For example, as illustrated in FIG. 3, a heat pipe 10' may instead have a generally curved, "U" shape or profile, such that a first end 14' and a second end 18' of the heat pipe 10' extend linearly and parallel to one another, and such that at least a portion of an intermediate region 22' has a bend that curves approximately 180 degrees. Any other curved heat pipe shape or profile is also possible. As illustrated in FIG. 4, a heat pipe 10" may instead have a plate-like shape (e.g., a generally flat, planar shape). As illustrated in FIG. 4, the heat pipe 10" may include a single evaporator region 30" defined by a portion (e.g., central portion) of a side of the heat pipe 10" and one or more condenser regions 34" generally disposed peripherally with respect to the evaporator region 30" (e.g., at corners, outer regions, or a periphery of the heat pipe 10"). In other embodiments, the evaporator region 30" is defined by any portion of all of one side of the heat pipe 10", while the condenser region 34" is defined by any portion or all of an opposite side of the heat pipe 10" (e.g., the underside of the heat pipe 10" shown in FIG. 4). Other embodiments include different shapes of heat pipes than those illustrated, as well as different locations for evaporator and condenser regions. For example, in some embodiments, a heat pipe may have a generally "J" shape (e.g., with legs that are unequal in length), an "S" shape, an "L" shape, a "U" shape, a "V" shape, or various other shapes having for example one, two, or more bends therein.

With reference again to the illustrated embodiment of FIGS. 1 and 2, the hollow body 26 of the heat pipe 10 is at least partially defined by a wall 46 having a wall thickness 50 (measured radially). The wall thickness 50 may be constant at different circumferential locations about the cross-sectional thickness of the heat pipe 10 (e.g., in cases where the heat pipe 10 was extruded, or if the heat pipe 10 was rolled or otherwise created from a constant-thickness material), although in other embodiments the wall thickness 50 may vary in one or more circumferential regions of the heat pipe 10 and/or may vary in thickness along the length of the heat pipe 10. In some embodiments, the wall thickness 50 is constant (both circumferentially and longitudinally) between the evaporator and condenser regions 30, 34.

Figure 7:
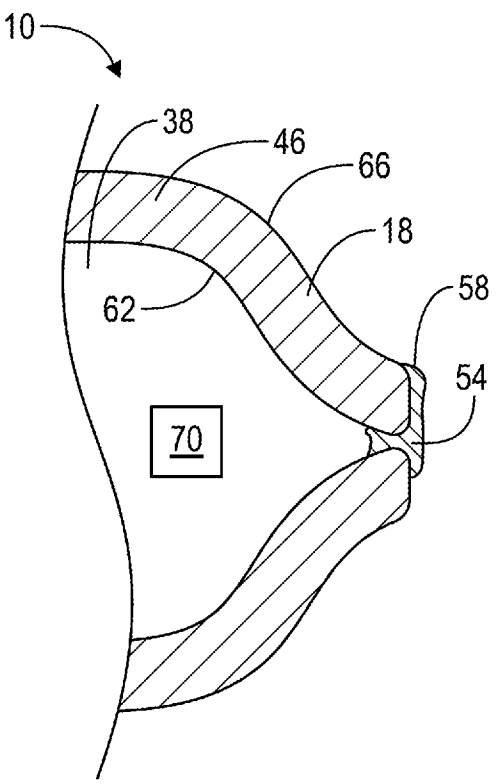
FIG. 7 is a partial view of the end of the heat pipe of FIG. 1, illustrating a seam formed instead by pinching the end of the heat pipe.
Figure 6:
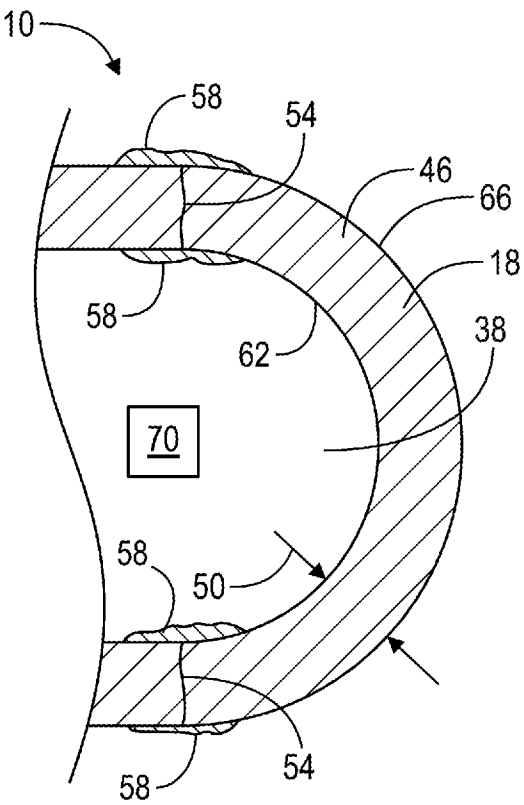
FIG. 6 is a partial view of an end of the heat pipe of FIG. 1, illustrating multiple seams instead of a single seam.
Figure 5:
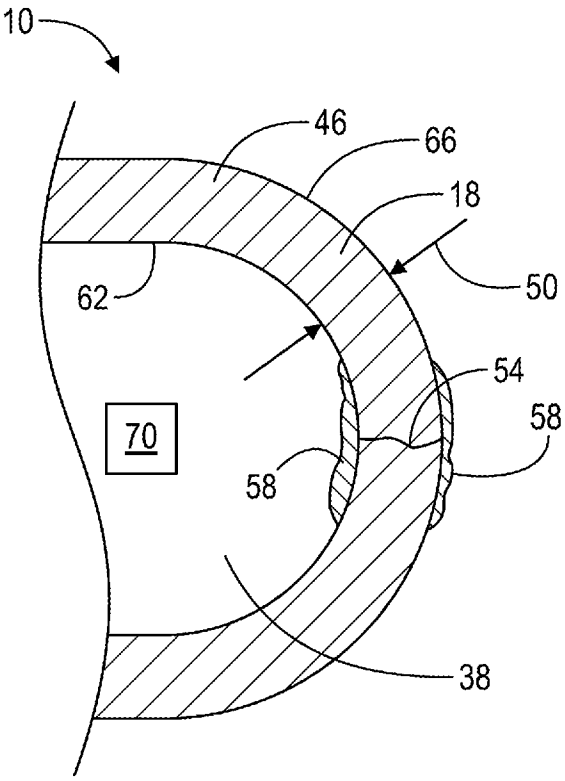
FIG. 5 is a partial view of an end of the heat pipe of FIG. 1, illustrating a seam.

With reference now to FIGS. 5-7, the heat pipe 10 also includes one or more seams 54 that must be sealed to isolate the vapor chamber 38 inside the heat pipe 10, and to create a vacuum in the vapor chamber 38. For example, the heat pipe 10 may be formed from multiple pieces that are sealed together at the first and/or second ends 14, 18 of the heat pipe 10. In both FIGS. 5 and 6, one or more seams 54 are located at the second end 18 of the heat pipe 10, with FIG. 5 illustrating a heat pipe 10 having just a single seam 54 at the second end 18 of the heat pipe 10, and FIG. 6 illustrating a heat pipe 10 having multiple seams 54 at the second end 18 of the heat pipe 10. Similar seams 54 may also or instead be located at the first end 14 of the heat pipe 10. In other embodiments, one or more seams 54 may also or instead be located along the intermediate region 22.

As illustrated in FIGS. 5 and 6, each of the seams 54 extends through the entire thickness 50 of the wall 46. In other embodiments, the seams 54 may be oriented or shaped differently. For example, the seams 54 may extend longitudinally along any part of the length 20 of the heat pipe 10. In some embodiments, the seams 54 may be smaller or larger than those illustrated, may be elongated, and/or may have a stepped or tapered shape with different depths in the wall 46 of the heat pipe 10. Any of the seams 54 can be defined by a hole, a slit or other elongated aperture, or can have any other shape desired. For example, with reference to FIG. 7, in some embodiments the heat pipe 10 is pinched, spun, compressed, or otherwise mechanically shaped at the second end 18 to at least partially close off the second end 18 of the heat pipe 10 and to help close the body 26 under vacuum. This mechanical shaping forces the body 26 of the heat pipe to form the seam 54.

The heat pipes 10 illustrated in FIGS. 5-7 are brazed along the seams 54 with a brazing material 58 instead of being welded. The brazing material 58 may fill the seam 54 from inside the heat pipe 10 within the vapor chamber 38 and adjacent (and in some embodiments, on) an internal surface 62 of the wall 46. The brazing material may be exposed to and in contact with the working fluid. The brazing material 58 may extend from the inside of the heat pipe 10 to an area outside the heat pipe 10, to an area adjacent (and in some embodiments, on) an external surface 66 of the wall 46. The brazing material 58 can define part or all of the internal surface of the vapor chamber 38 at, and in some cases also adjacent, the seams 54. In some embodiments, the brazing material 58 may fill only a portion of the seam 54 (e.g., only to a partial depth through the wall 46). Also in some embodiments, the brazing material may not extend entirely to the internal surface 62 and/or to the external surface 66. Also, the brazing material 58 may in general have the same shape and/or size as the seam 54 itself, such as to fill a seam 54 having a constant thickness between the inner and outer surfaces of the wall 46, to fill a seam 54 having a tapered or stepped thickness at different depths through the thickness of the wall 46, and to fill seams 54 having any other shape desired.

With continued reference to the illustrated embodiments, the brazing material 58 may cover the external surface 66 of the wall 46 around the seam 54 (e.g., forming a "cap" or other covering of brazing material) around an end or other portion of the heat pipe 10. Similarly, the brazing material 58 may cover the internal surface 62 of the wall 46 around the seam 54 (e.g., forming a lining or other covering of brazing material) inside an end or other portion of the heat pipe 10. The brazing material 58 inside the vapor chamber 38 may be bare, or may be covered partially or entirely by the wick structure 42. Additionally, the brazing material 58 may at least partially fill the seam 54 to hermetically seal the internal chamber 38 and to maintain a vacuum in the internal chamber 38.

As described above, when a heat pipe that uses water as the working fluid is subjected to temperatures below water's freezing point, the water will form a charge of ice 70 (illustrated schematically) within the heat pipe's internal vapor chamber 38, and in some embodiments, partially or entirely within the wick structure 42 in the chamber 38. For example, water heat pipes located in a zero-gravity environment are often subjected to repeated freeze/thaw cycles that can form a charge of ice 70 during each freeze cycle within the heat pipe's vapor chamber. Water that has accumulated at or found its way into imperfections in the surface of the heat pipe can freeze and expand inside the imperfections, causing damage to the welds and heat pipe over time from repeated freeze/thaw cycles. In those cases where the seams 54 are welded, water can also or instead find its way into imperfections (e.g., pores or fissures) in the welds, and can freeze and expand inside such imperfections to cause damage to the welds and heat pipe over time during repeated freeze/thaw cycles.

The inventors, however, have discovered that a brazed heat pipe works surprisingly well in low temperature environments, and that welded heat pipes may also work well in low temperature environments, given one or more of the heat pipe features described herein. In those embodiments where brazing is used, it is believed that the brazing material 58 covers, and in some cases fills the imperfections (including imperfections that arise at or adjacent the seams 54) created during the production process of the heat pipe 10 (e.g., along the internal surface of the heat pipe 10). By covering, and in some cases filling these imperfections, the brazing material 58 inhibits or prevents water from accumulating at or within the imperfections and expanding in such imperfections upon freezing.

Additionally, it is believed that proper brazing of the seam(s) 54 as described above provides internal seam and brazing material surfaces with fewer or no imperfections (e.g., pores) as compared with welding. With fewer or no imperfections at the seam(s) 54 and brazing material, it is also believed that the resulting heat pipes 10 are less likely to retain water that, when frozen, causes fracturing or deterioration along or around the heat pipe's seams 54. Accordingly, brazed heat pipes according to the various embodiments herein are better able to withstand many more freeze/thaw cycles (e.g., thousands of freeze/thaw cycles).

In addition to the use of brazing, the inventors have also discovered that polishing or otherwise smoothing out the internal surfaces of the heat pipe 10 may also beneficially reduce or eliminate heat pipe failure or damage when water is used as the working fluid in low temperature environments—both for welded and brazed heat pipe seams as described herein. For example, once the end of the heat pipe 10 has been formed, and before or after sealing the end of the heat pipe 10 (e.g., via welding, brazing, or any other technique), the internal surface(s) of the heat pipe 10 may be polished. In some embodiments, a cylindrical or other shaped mandrel or other polishing tool (such as tool 76 described further below) may be inserted into the heat pipe 10 and rotated or reciprocated relative to the heat pipe 10 to polish the internal surfaces of the heat pipe 10, thereby reducing and/or removing any imperfections that would otherwise give rise to water accumulation and eventual damage to the heat pipe 10 as described herein. In this polishing process, a thin layer of the interior heat pipe wall is removed or smoothed out, and any imperfections in the interior wall are likewise reduced in size and/or number or eliminated entirely, including at and/or adjacent the seams 54. Imperfections in the brazing material at and/or adjacent the seams 54 can similarly be eliminated entirely or reduced in number and/or size. It will be appreciated that similar polishing can be used to remove imperfections in weld material in or adjacent the seams 54 of the heat pipe 10, in those embodiments in which the seams 54 are instead welded.

In other embodiments, a polishing tool as described above functions to elevate the temperature of the interior heat pipe wall and/or the brazing material to a level at which the imperfections are partially or fully closed, such as by fusing or collapsing the material defining the imperfections under heat and pressure.

Figure 8:
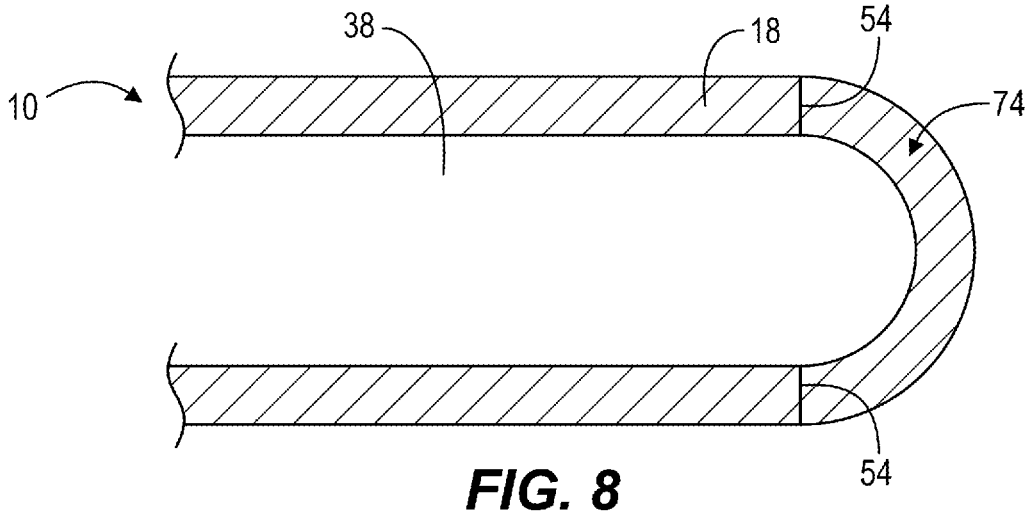
FIG. 8 is a partial view of an end of the heat pipe of FIG. 1, further illustrating an end cap attached to the end of the heat pipe.

In addition to brazing and/or polishing, the inventors have also discovered that using end caps may also beneficially reduce or eliminate heat pipe failure or damage that would otherwise result when water is used as the working fluid. For example, and with reference to FIG. 8, the heat pipe 10 may be formed by attaching (e.g., via welding, brazing, or by other suitable joining techniques) an end cap 74 to the second end 18 of the body 26 of the heat pipe 10. In other words, rather than pinching, spinning, or otherwise deforming the second end 18 of the heat pipe 10, which may give rise to many or all of the imperfections described above, the end cap 74 may instead first be created separately apart from the rest of the heat pipe 10 by one or more machining operations or by other operations that do not subject the cap to the forces that create the imperfections as described above. Advantageously, a machined end cap 74 may be easily inspected (e.g., for defects, cracks, etc.) prior to attachment. Once formed (and for example, properly examined), the end cap 74 is then attached directly to the second end 18 of the heat pipe 10. In some embodiments, the end cap 74 has a dome shape (e.g., as seen in FIG. 8), although other cap shapes are possible, such as conical shapes and irregular shapes. The end cap 74 illustrated in FIG. 8 has constant wall thickness. However, in other embodiments, the wall thickness of the end cap 74 can vary along its length. For example, the wall of the end cap 74 may be thicker proximate the closed tip of the end cap 74 in comparison to the open portion of the end cap 74 adjacent the junction with the heat pipe 10, or vice versa. This varying wall thickness produces end caps 74 whose shapes are adapted to provide additional strength in locations where the greatest stresses result from repeated freeze/thaw cycles.

In the embodiment of FIG. 8, the end cap 74 can be welded, brazed, or otherwise attached to the second end 18 of the heat pipe 10 along a seam or seams 54 formed between the end cap 74 and the second end 18 of the heat pipe 10. The end cap 74 can have dimensions, for example, that correspond to the second end 18 of the heat pipe 10 so that the cap evenly fits against the second end 18 of the heat pipe 10. For example, the end cap 74 can be shaped so that faces of the end of the heat pipe 10 and the faces of the end cap 74 adjacent the heat pipe 10 are abutting and planar, or are separated only by a layer of brazing or welding material (not shown). As another example, the end cap 74 can be shaped with an internal or exterior taper to mate with an exterior or internal taper of the end of the heat pipe 10, respectively. As yet another example, the end cap 74 and/or heat pipe 10 can be shaped to have stepped ends for mating engagement with one another. Still other interfaces between the end cap 74 and the heat pipe 10 that define the seam 54 in locations spaced away from the closed tip of the end cap 74 are possible. In some embodiments, and in contrast to the embodiment illustrated in FIG. 6, the seam 54 formed between the end cap 74 and the second end of the heat pipe 10 can be smoothed or polished to reduce the likelihood of imperfections where water may pool or otherwise accumulate.

Accordingly, a heat pipe 10 that is closed off with an end cap 74 may have fewer imperfections at the closed end of the heat pipe 10 that would cause water to accumulate and pool, thereby reducing or eliminating the chance of freezing and expansion of water at or in such imperfections that may cause heat pipe failure or damage. By using the end cap 74, the only seams present are generally relatively smooth, and form boundaries between the heat pipe 10 and the end cap 74 with fewer or no imperfections. For this reason, in some constructions that use an end cap 74, welded seams 54 (as an alternative to brazed seams) can become an attractive design option to seal the end cap 74 to the heat pipe 10 while still resulting in a heat pipe 10 that performs satisfactorily in freeze/thaw environments.

Figure 9:
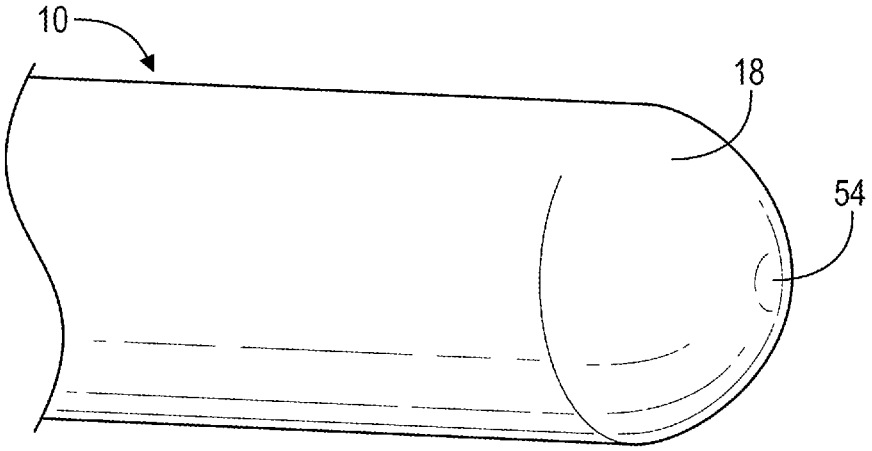
FIG. 9 is a perspective view of an end of the heat pipe of FIG. 1, the end of the heat pipe having been spun closed so as to form a seam or hole.

FIGS. 9-19 illustrate an exemplary process for forming heat pipes 10. As illustrated in FIG. 9, the second end 18 of the heat pipe 10 may be spun (e.g., on a lathe or other device) until the material of the second end 18 begins to deform and close shut to form a generally rounded (e.g., hemispherical or dome-shaped) end having a centrally-located seam 54. As noted above, the heat pipe 10 may be a straight heat pipe 10, or may be curved or otherwise bent in one or more directions, prior to or after spinning the second end 18. Additionally, the first end 14 of the heat pipe 10 may additionally or alternatively be spun in a similar manner, or may be otherwise generally be closed off (e.g., via pinching or pressing).

Figure 10:
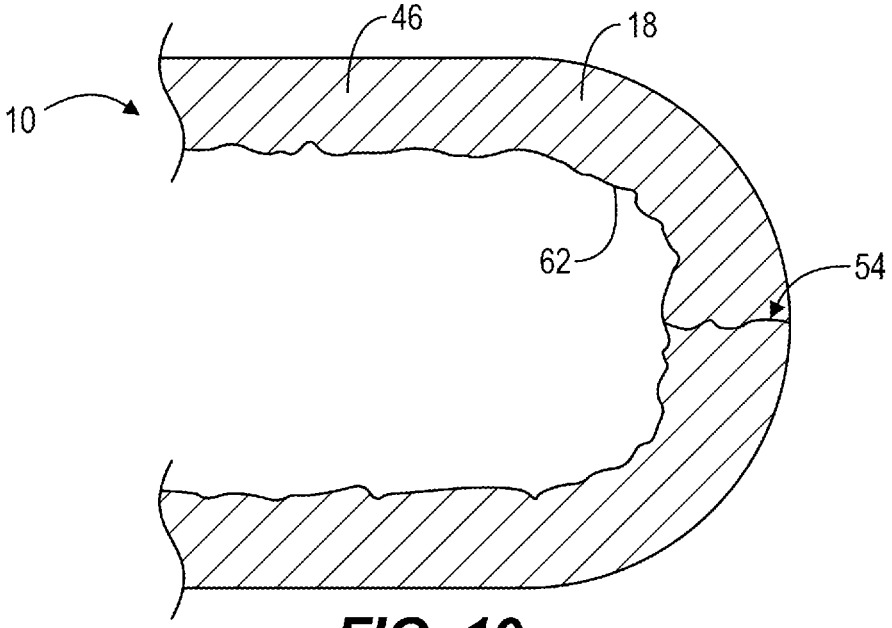
FIG. 10 is a cross-sectional view of the end of the heat pipe of FIG. 9, illustrating an internal surface of the heat pipe prior to being smoothed out.
Figure 11:
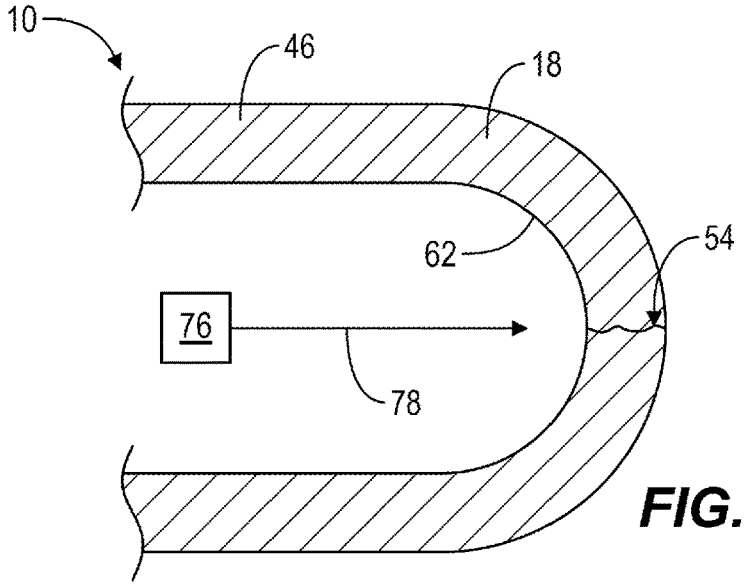
FIG. 11 is a cross-sectional view of the end of the heat pipe of FIG. 10, illustrating the internal surface of the heat pipe after having been smoothed out.

With reference to FIG. 10, once the second end of the heat pipe 10 has been spun (or otherwise closed off), the internal surface 62 of the wall 46 of the heat pipe 10 may be rough, uneven, and have undulations, jagged ridges, or other imperfections. Accordingly, and with reference to FIG. 11, in the illustrated embodiment a tool 76 (e.g., a machining, finishing, and/or polishing device, such as a rotating hemispherically-shaped polishing device, illustrated schematically) is inserted axially along a direction 78 toward the second end 18 of the heat pipe 10, and is used to machine and/or polish, or otherwise smooth out the internal surface 62, in some cases until the internal surface 62 is smooth and has a generally hemispherical shape as seen in FIG. 11. In other embodiments, the tool 76 is not used, and no smoothing of the internal surface 62 occurs.

Figure 12:
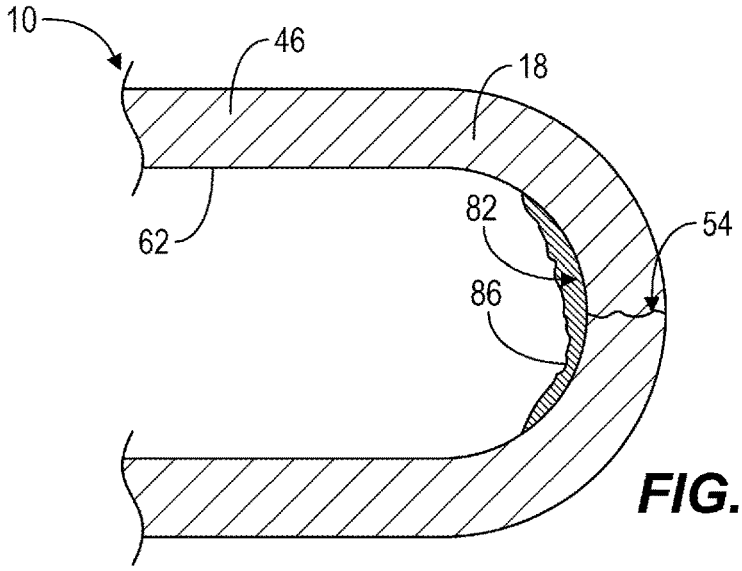
FIG. 12 is a cross-sectional view of the end of the heat pipe of FIG. 11, illustrating a first brazing material applied to the smoothed out internal surface of the heat pipe.

With reference to FIG. 12, once the internal surface 62 has been smoothed out, an internal layer of brazing material 82 (e.g., similar to brazing material 58 described above) may be applied to the internal surface 62 at the second end 18 of the heat pipe 10, generally at the location of the seam 54. In the illustrated embodiment, the internal layer of brazing material 82 is a powder, such as AuCu powder (a gold copper alloy braze powder), although other embodiments include different materials and compositions, including non-powder materials. In some embodiments, a portion of the internal layer of brazing material 82 may extend into the seam 54. In those embodiments in which the internal surface processing (e.g., smoothing) step described in connection with FIG. 11 is not performed, the internal layer of brazing material 82 can still be applied to the internal surface 62 at the second end 18 of the heat pipe 10 as described herein to provide improved heat pipe performance in freeze/thaw applications.

Figure 13:
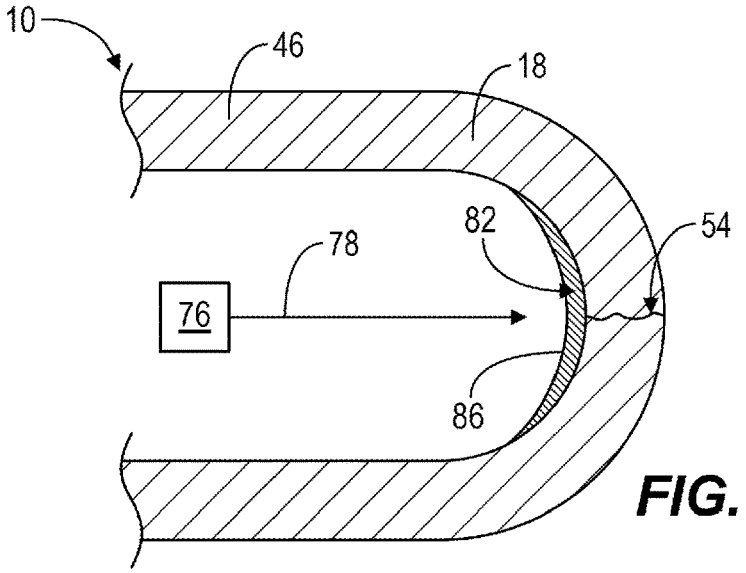
FIG. 13 is a cross-sectional view of the end of the heat pipe of FIG. 12, illustrating an internal surface of the first brazing material after having been smoothed out.

With reference to FIGS. 12 and 13, after the internal layer of brazing material 82 has been applied, brazed (e.g., at 1025° C. or higher, or another suitable temperature for brazing), and cooled, the brazing material 82 forms a solid, internal surface 86 within the heat pipe 10. However, the internal surface 86 may be uneven, and have undulations, ridges, or other imperfections. Accordingly, and with reference to FIG. 13, in the illustrated embodiment the tool 76 (or another tool) is inserted axially along the axial direction 78 again toward the second end 18 of the heat pipe 10, and is used to machine and/or polish, or otherwise smooth out the internal surface 86 of the solidified internal layer of brazing material 82 until the internal surface 86 is smooth. In some embodiments, the smoothed internal surface 86 can have a generally hemispherical shape, such as that shown in FIG. 13. In other embodiments, the tool 76 is not used, and no smoothing of the internal surface 86 occurs.

While in some embodiments polishing or smoothing of the internal surface 62 of the wall 46 of the heat pipe 10 is performed, followed by polishing or smoothing the internal surface 86 of the internal layer of brazing material 82, in other embodiments only the internal surface 62 of the wall 46 is smoothed, and the internal surface 86 of the internal layer of brazing material 82 is left less smooth than the internal heat pipe surface 86. Alternatively, in other embodiments only the internal surface 86 of the internal layer of brazing material 82 is smoothed, and the internal surface 62 of the wall 46 is left less smooth than the internal surface 86 of the brazing material. Additionally, in some embodiments, smoothing of at least a portion of the internal surface 62 of the wall 46 (e.g., adjacent the internal layer of brazing material 82) is performed subsequent to smoothing of the internal surface 86 of the internal layer of brazing material 82.

Figure 14:
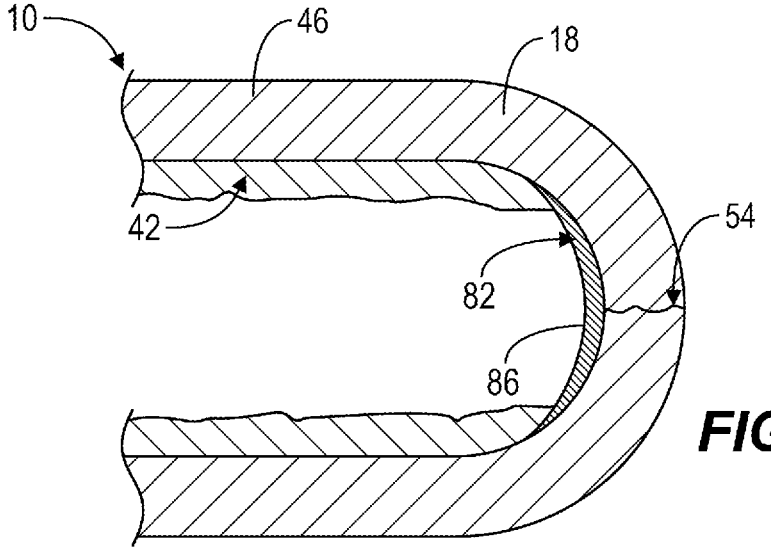
FIG. 14 is a cross-sectional view of the end of the heat pipe of FIG. 13, illustrating a wick structure applied to the internal surface of the heat pipe.

With reference now to FIG. 14, after the internal surface 86 of the internal layer of brazing material 82 has been smoothed, the wick structure 42 may be added to the heat pipe 10. For example, a mandrel (not illustrated) may be inserted into the heat pipe 10, and wick material (e.g., powdered wick material) may be inserted into a radial gap between an outside of the mandrel and the internal surface 62 of the heat pipe 10. The wick structure 42 may include, for example, particles of copper powder or other material (e.g., gold, silver, etc.) that may be sintered, fused, brazed, or otherwise held together. The particles may be spherical, oblate, dendritic, irregular, or can have other shapes, and may form pores between the particles. Once the particles of the wick structure 42 have been inserted, the wick structure 42 can be sintered (e.g., at a temperature that is lower than the brazing temperature described above, such as 625° C., or 965° C., or other suitable temperatures for sintering) to form a solid, porous wick structure 42 within the heat pipe 10.

In some embodiments, the smoothing of the internal surface 86 of the internal layer of the brazing material 82 may occur, for example, after the addition of the wick structure 42, or both before and after the addition of the wick structure 42. In yet other embodiments, the addition of the internal layer of the brazing material 82 itself (and for example the smoothing of the internal surface 86) may occur after the addition of the wick structure 42 to the heat pipe 10. In yet other embodiments, the wick structure 42 is not included in the heat pipe 10 (e.g., where the heat pipe 10 is being used in environments that have sufficient gravity to return the working fluid to the evaporator region 30).

Figure 15:
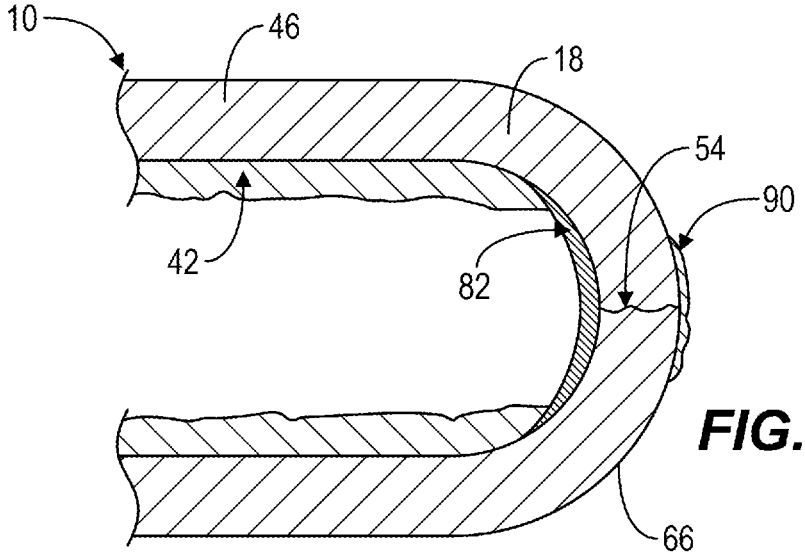
FIG. 15 is a cross-sectional view of the end of the heat pipe of FIG. 14, illustrating a second brazing material applied to the external surface of the heat pipe.

With reference to FIG. 15, an external layer of brazing material 90 may also be added to the external heat pipe surface 66. In the illustrated embodiment of FIG. 15, the external layer of brazing material 90 extends over the seam 54. A portion of the external layer of brazing material 90 may extend into the seam 54 and/or contact the internal layer of brazing material 82. The external layer of brazing material 90 may be different in composition from the internal layer of brazing material 82. For example, in the illustrated embodiment, the internal layer of brazing material 82 is AuCu, whereas the external layer of brazing material 90 is a silver copper alloy brazing material (a silver brazing alloy). Other embodiments include different materials. In some embodiments, the internal layer of brazing material 82 is identical in composition to the external layer of brazing material 90.

While the illustrated embodiment of FIG. 15 includes adding an external layer of brazing material 90 after adding an internal layer of brazing material 82, in other embodiments the external layer of brazing material 90 may be added prior to the addition of the internal layer of brazing material 82, and/or prior to addition of the wick structure 42, and/or prior to smoothing of the internal surface 86 of the internal layer of brazing material 82, and/or prior to smoothing of the internal surface 62 of the wall 46. Once the external layer of brazing material 90 is added, the external layer of brazing material 90 is then brazed (e.g., at 1025° C. or higher, or another suitable temperature for brazing). The external layer of brazing material 90 may be brazed at the same temperature as the brazing of the internal layer of brazing material 82, or may be brazed at a different temperature.

With continued reference to FIGS. 12-15, in some embodiments the heat pipe 10 does not include both the internal layer of brazing material 82 and the external layer of brazing material 90. For example, in some embodiments only the external layer of brazing material 90 is applied to the heat pipe 10, and the internal layer of brazing material 82 is omitted. In yet other embodiments, the internal layer of brazing material 82 is applied to the heat pipe 10, and the external layer of brazing material 90 is omitted. Additionally, while the layers of brazing material are illustrated only for a single seam 54 in FIGS. 9-19, in other embodiments with more than one seam 54 (e.g., as seen in FIG. 6), one or more of the internal layer of brazing material 82 and the external layer of brazing material 90 may be applied at each of the seams 54. In some embodiments, only the steps of spinning the end of the heat pipe 10 and then applying one or more of the internal or external layers of brazing material 82, 90 at the seams 54 are performed, and other steps described herein (e.g., polishing internal surfaces and/or adding a wicks structure 42) are omitted.

In any of the embodiments described and/or illustrated herein, one or more of the heat pipe seams 54 are welded rather than brazed. In such embodiments, the seam(s) 54 are partially or completely filled with weld material in any of the manners described herein with reference to braze material partially or completely filling the seam(s) 54. Also in such embodiments, the internal and/or external layers of brazing material 82, 90 can still be used to improve performance of the heat pipe 10. For example, by at least partially covering the welded seam 54 of the heat pipe 10 with an internal layer of braze material 82 in any of the manners described herein, the ability of water as the internal working fluid to come into contact with the weld material within the seam 54 can be reduced or eliminated, thereby extending the lifespan of the heat pipe 10 in freeze-thaw applications. Also, any of the other surface processing features and steps described herein (e.g., machining, polishing, or otherwise smoothing of the internal surface 62 of the heat pipe wall 46 and/or the internal surface 86 of the internal layer of brazing material 82) can be performed upon heat pipes having welded seams, rather than brazed seams as described herein.

Figure 16:
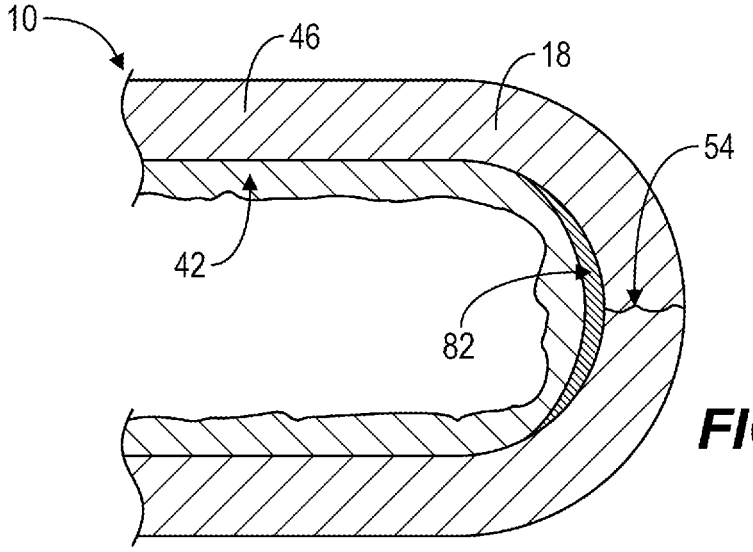
FIG. 16 is a cross-sectional view of the end of the heat pipe of FIG. 9, illustrating a wick structure that extends entirely around the end of the heat pipe within an internal of the heat pipe.
Figure 17:
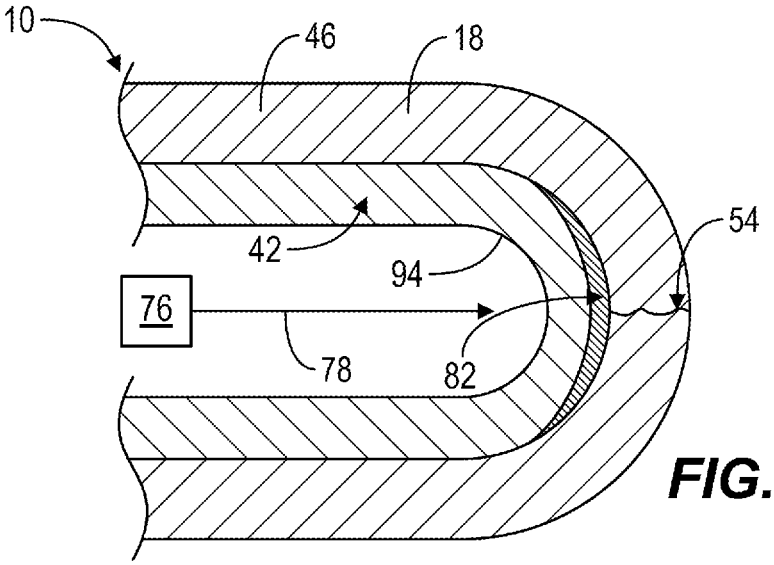
FIG. 17 is a cross-sectional view of the end of the heat pipe of FIG. 16, illustrating an internal surface of the wick structure after having been smoothed out.

With reference to FIGS. 16 and 17, in addition to brazing, polishing, and using end caps, the inventors have also discovered that use of a wick structure which extends entirely around an inside of the end of the heat pipe 10 may also beneficially reduce or eliminate heat pipe failure or damage that may otherwise result when water is used as the working fluid in freeze/thaw applications. For example, once the internal layer of brazing material 82 has been added (and in some cases after the internal surface 86 has been smoothed), the wick structure 42 may be applied, such that the wick structure 42 extends not only over the internal surface 62 of the wall 46, but also over the internal surface 86 of the internal layer of brazing material 82. Such a wick structure 42 may be formed, for example, by pressing a mandrel (not illustrated) axially into the heat pipe 10, but not pressing it far enough axially to prevent wick material from entering and occupying a space between an end of the mandrel and the internal layer of brazing material 82. Rather, a small axial gap may be left at the second end 18 of the heat pipe 10 between an outer surface of the mandrel and the inner surfaces of the heat pipe 10 and brazing material 82 in which un-sintered particles of the wick structure 42 can collect. Once the particles have been sintered, the solidified wick structure 42 can extend entirely around the second end 18 of the heat pipe 10 as illustrated in FIG. 16. Providing such a wick structure may help to cover or fill in imperfections that otherwise exist on the inside of the heat pipe 10 or on the internal layer of brazing material 82. Additionally, providing such a wick structure may facilitate faster flow of condensed water away from the condenser region 34 of the heat pipe 10, preventing water from accumulating, freezing, and eventually expanding at or within any imperfections inside the heat pipe 10, and thereby damaging the heat pipe 10.

With continued reference to FIG. 16, in some embodiments an internal surface of the wick structure 42 itself may be rough, uneven, and have undulations, jagged ridges, or other imperfections. Thus, as illustrated in FIG. 17, the tool 76 (or another tool) may be inserted axially along the direction 78 again toward the second end 18 of the heat pipe 10, and may be used to machine and/or polish, or otherwise smooth one or more internal surfaces 94 of the wick structure 42, until the wick structure 42 is smooth and has a generally hemispherical shape as seen in FIG. 17.

The formation of a wick also may result in imperfections inside the heat pipe 10. The polishing and smoothing processes described above may help to reduce or eliminate such imperfections not only on the inside surface of the heat pipe 10 and brazing or welding material, but also on the wick. By creating smooth internal surfaces, the likelihood of water accumulating and/or pooling is reduced or eliminated, and the likelihood of heat pipe failure or damage caused by repeated freeze/thaw cycles can be reduced or eliminated.

Figure 18:
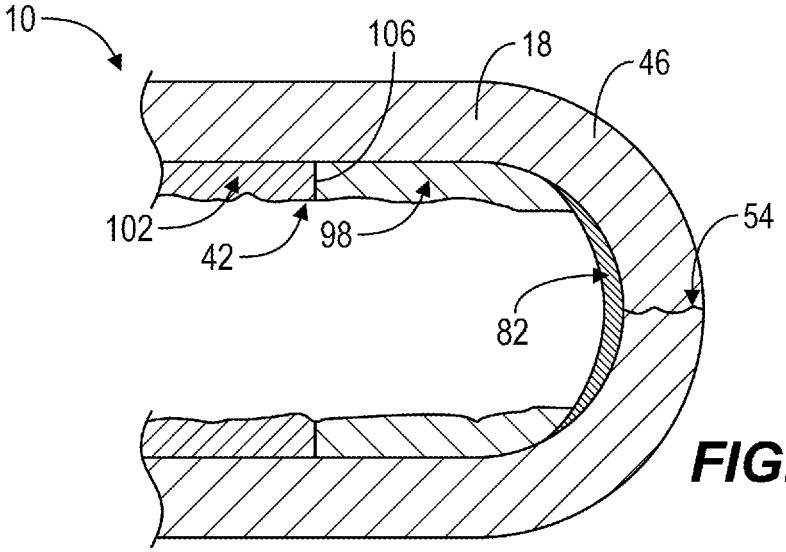
FIGS. 18 and 19 are cross-sectional views of the end of the heat pipe of FIG. 9, illustrating a graded wick structure applied to an internal surface of the heat pipe, the graded wick structure including regions with variable permeability.
Figure 19:
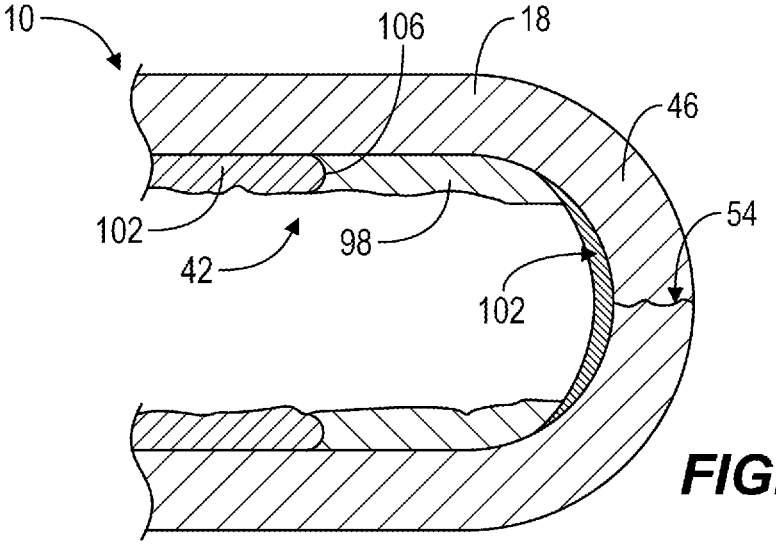

With reference to FIGS. 18 and 19, in addition to brazing, polishing, and using end caps and wicks, the inventors have also discovered that using a graded wick structure may beneficially reduce or eliminate heat pipe failure or damage that would otherwise result when water is used as the working fluid in freeze/thaw applications. For example, in some embodiments the wick structure 42 may be a graded wick structure having variable permeability, and includes various wick structure regions along the heat pipe having particles and pores (spaces between the particles) of different size. In the illustrated embodiment of FIGS. 18 and 19, the wick structure 42 includes a first wick structure region 98 and a second wick structure region 102 extending from the first wick structure region 98. The first wick structure region 98 includes particles or pores of a first average size, and the second wick structure region 102, which may be made of the same or different material than the first wick structure region 98, includes particles or pores of a second average size that is different from the first average size. Thus, the permeability of the first wick structure region 98 can differ from the permeability of the second wick structure region 102.

In some embodiments, the wick structure 42 includes more than two wick structure regions extending axially along the heat pipe 10, and/or includes two or more wick structure regions that are axially spaced apart from one another by gaps along and within the heat pipe 10, rather than extending directly from another wick structure region. Additionally, in some embodiments, the wick structure 42 and its various wick structure regions extends entirely from the evaporator region 30 to the condenser region 34.

Overall, the graded wick structure 42 may have a fluid permeability that varies in the different wick structure regions of the wick structure 42. The use of two or more wick structure regions having particle sizes, pore sizes, and/or permeability that increase from the evaporator region 30 to the condenser region 34 may facilitate a more efficient pumping action than a wick structure 42 having a uniform particle size throughout. For example, a larger particle size (and pore size) at the condenser region 34 of the heat pipe 10 can allow for evaporated working fluid to quickly pass into the wick structure 42 and move back toward the evaporator region 30. Conversely, an increasingly smaller particle size (and pore size) moving along the heat pipe 10 toward the evaporator region 30 can facilitate a greater pumping action as liquid travels away from cooler areas of the heat pipe 10 proximate the condenser region 34 toward warmer areas of the heat pipe 10 proximate the evaporator region 30—and as liquid nearer the evaporator region 30 evaporates and escapes the smaller particle/smaller pore wick structure proximate that region. Thus, working fluid may naturally accumulate and flow toward the evaporator region 30, where it is held and heated by at least one heat source.

With continued reference to FIGS. 18 and 19, boundaries 106 between the wick structure regions may be oriented and shaped in various manners. For example, as illustrated in FIG. 18, in some embodiments the boundary 106 may extend radially in a plane that is perpendicular with respect to the axis of the heat pipe 10, or may be tapered with respect to the axis (i.e., forming a generally frustoconical shape). As illustrated in FIG. 19, in some embodiments the boundary 106 may have more of a concave or convex shape. Other embodiments include various other orientations and shapes. The boundaries 106 of the wick structure regions may be formed, for example, by the same tool 76 described above, or by another tool, such that the boundaries are smooth and define one or more ledges or surfaces facing an open end of the heat pipe 10 during formation of the wick structure 42. In some embodiments, after the first wick structure region 98 has been smoothed at the boundary 106, the second wick structure region 102 may then be formed, abutting the first wick structure region 98, whether in a sintering operation at the same temperature or at a lower temperature as used in formation of the first wick structure region 98. The sintering temperatures used to form the various wick structure regions may each be lower than the temperatures used to braze the one or more layers of brazing materials described herein.

By using a graded wick structure 42 as described above, water inside the heat pipe 10 can flows more quickly away from the condenser region 34 of the heat pipe 10, where the water may otherwise accumulate and/or pool at or within any imperfections in the heat pipe described herein. A graded wick may therefore further reduce or eliminate heat pipe failure or damage caused by repeated freeze/thaw cycles.

With reference overall to FIGS. 1-19, the working fluid inside the heat pipe 10 may undergo many cycles of freezing and thawing during use in low temperature environments. Heat from a heat source may be applied to the heat pipe 10 (e.g., at the evaporator) continuously during these freeze/thaw cycles of the heat pipe 10 ("powered freeze/thaw"). Alternatively, heat may be turned off during a freeze cycle (i.e., wherein the working fluid freezes), but then applied again during a thaw cycle ("cold start"). Alternatively, no heat may be applied to the heat pipe 10 during periods of time in which the heat pipe 10 is exposed to one or more freeze/thaw cycles ("unpowered freeze/thaw").

In some embodiments, heat can be applied to the heat pipe 10 even when part of the working fluid or all of the working fluid is frozen (see for example, frozen charge of ice 70 in FIGS. 5-7), and the heat pipe 10 will still operate. The frozen charge of ice 70 and such operation is applicable to all embodiments of the present invention described herein. For example, during a powered freeze thaw, some or all of the working fluid may be frozen. Additionally, during a cold start, some or all of the working fluid may be frozen. In such instances, heat from the heat source may melt at least a portion of the frozen water inside the heat pipe (e.g., simply through heating the pipe material itself, or the proximity of the heat source to the frozen water inside the heat pipe 10), causing the water to evaporate at the evaporator region 30 and to flow as water vapor to the condenser region 34. There, the water vapor will be condensed, and will find its way back to the evaporator region 30. As heat continues to be applied to the heat pipe 10 by the heat source, the frozen water inside can continue to melt, allowing more of the working fluid water to be vaporized and flow to the condenser region 34.

Throughout this process, the frozen water inside the heat pipe 10 may be prevented from damaging the heat pipe 10 using any of the features and manufacturing methods described herein. In particular, it has been found that in certain embodiments, the combination of spinning and/or brazing and/or polishing/smoothing described above along the interior surfaces of the heat pipe 10 and/or at the end(s) of the heat pipe 10 inhibits cracking and/or other damage to the heat pipe 10 when the heat pipe 10 is used with water as a working fluid in freeze/thaw cycles, which enables the heat pipe 10 to continue operating at a functional level despite the presence of the frozen water therein. Additionally, in some embodiments where no heat is actively being applied (e.g., during an unpowered freeze/thaw) the heat pipe 10 may still operate by virtue of heat that has previously been received and conducted through the body 26 of the heat pipe 10, or by virtue of heat that is received from a source other than a primary heat source.

Although the present invention has been described in detail with reference to certain embodiments, variations and modifications exist within the scope and spirit of one or more independent aspects of the invention as described.

What is claimed is:

1. A heat transfer device comprising:

a hollow metal body, the hollow body defining:

a wall having a thickness;

an internal chamber defined at least in part by the wall;

a vacuum defined in the internal chamber;

a seam defined between two different portions of the wall and extending from an internal surface to an external surface of the hollow metal body;

an evaporation region in which heat is received in the hollow metal body;

a condenser region from which heat is discharged from the hollow metal body;

a working fluid within the internal chamber drawing heat from the evaporator region and discharging heat from the condenser region in a working cycle of the heat transfer device, wherein the wall comprises an internal polished surface within the hollow metal body, worked to remove or reduce in number or size imperfections that would otherwise accumulate the working fluid; and a brazing material applied to the internal polished surface to hermetically seal the internal chamber and maintain the vacuum in the internal chamber, wherein the brazing material forms a continuous layer that extends across the seam on the internal polished surface.

2. The heat transfer device of claim 1, wherein the hollow body comprises copper.

3. The heat transfer device of claim 1, wherein the hollow body is elongated between the evaporator region and the condenser region.

4. The heat transfer device of claim 1, further comprising a capillary wick located within the internal chamber between the evaporator region and the condenser region, wherein a first portion of the capillary wick extends along the internal polished surface of the wall, and a second portion of the capillary wick extends along an interior surface of the continuous layer of brazing material, wherein the capillary wick forms a continuous capillary wick structure that extends across the seam.

5. The heat transfer device of claim 1, wherein the evaporator and condenser regions are at different ends of the hollow body.

6. The heat transfer device of claim 1, wherein the seam is located at an end of the hollow body.

7. The heat transfer device of claim 1, wherein the seam is an elongated seam.

8. The heat transfer device of claim 1, wherein the brazing material extends through the seam between the internal surface of the hollow metal body and the external surface of the hollow metal body.

9. The heat transfer device of claim 1, wherein the internal polished surface is a first internal polished surface, wherein the brazing material comprises a second internal polished surface within the hollow metal body worked to remove or reduce in number or size imperfections that would otherwise accumulate the working fluid.

10. The heat transfer device of claim 1, wherein the internal polished surface is a surface that has been worked by a polishing tool such that the imperfections which would otherwise accumulate the working fluid are partially or fully closed, by a fusing or collapsing of the material defining the imperfections.

11. The heat transfer device of claim 1, wherein the imperfections include at least one of a fissure, crack, crevasse, void, or pore that extends radially through the wall.

12. The heat transfer device of claim 1, wherein the wall defines an axial end of the heat transfer device, and wherein the axial end of the heat transfer device includes the internal polished surface.

* * * * *